US008358741B2

(12) United States Patent
Grasruck et al.

(10) Patent No.: US 8,358,741 B2
(45) Date of Patent: Jan. 22, 2013

(54) DEVICE AND METHOD TO CONTROL AN ELECTRON BEAM FOR THE GENERATION OF X-RAY RADIATION, IN AN X-RAY TUBE

(75) Inventors: Michael Grasruck, Erlangen (DE); Andreas Schaller, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 225 days.

(21) Appl. No.: 12/857,676

(22) Filed: Aug. 17, 2010

(65) Prior Publication Data

US 2011/0038460 A1 Feb. 17, 2011

(30) Foreign Application Priority Data

Aug. 17, 2009 (DE) ..... 10 2009 037 688

(51) Int. Cl.
*H01J 35/30* (2006.01)

(52) U.S. Cl. ..... 378/137; 378/113; 378/136; 378/138

(58) Field of Classification Search ..... 378/16, 378/113, 136, 137, 138
See application file for complete search history.

(56) References Cited

U.S. PATENT DOCUMENTS 4,104,526 A 8/1978 Albert
5,563,923 A * 10/1996 Okada et al. ..... 378/138
6,111,933 A * 8/2000 Schaaf et al. ..... 378/137
6,381,305 B1 * 4/2002 Okada et al. ..... 378/137
6,438,207 B1 * 8/2002 Chidester et al. ..... 378/138
6,456,691 B2 * 9/2002 Takahashi et al. ..... 378/122
6,826,255 B2 * 11/2004 Birdwell et al. ..... 378/137
6,944,268 B2 * 9/2005 Shimono ..... 378/111
6,968,039 B2 * 11/2005 Lemaitre et al. ..... 378/138
7,019,294 B2 * 3/2006 Koyama et al. ..... 250/311
7,123,688 B2 * 10/2006 Negle ..... 378/113
7,406,154 B2 * 7/2008 Resnick ..... 378/113
8,189,742 B2 * 5/2012 Behling ..... 378/137
2004/0114722 A1 6/2004 Shimono
2010/0172475 A1 7/2010 Behling

* cited by examiner

*Primary Examiner* — Allen C. Ho
(74) *Attorney, Agent, or Firm* — Schiff Hardin LLP

(57) ABSTRACT

A device to control an electron beam for the generation of x-ray radiation, has an electron emitter to generate an electron beam, to which emitter an emitter voltage can be applied, a diaphragm, at least two control elements associated with the diaphragm to affect the electron beam, and switching arrangement with which at least two different electrical voltages can be applied to the at least two control elements. The same electrical voltage is applied to each of the at least two control elements. Upon switching the voltage, an electrical circuit that delays the setting of the respective voltage at the one control element is associated with the connection line of the one control element with the switching arrangement to switch over the voltage. The invention moreover concerns an operating method for the device and an x-ray tube provided with the device.

17 Claims, 4 Drawing Sheets

DEVICE AND METHOD TO CONTROL AN ELECTRON BEAM FOR THE GENERATION OF X-RAY RADIATION, IN AN X-RAY TUBE

BACKGROUND OF THE INVENTION

1. Field of the Invention

The present invention concerns a device and a method to control an electron beam emanating from an emitter of electrons for the generation of x-ray radiation, in particular for the modulation of x-ray radiation. The invention moreover concerns an x-ray tube having such a device.

2. Description of the Prior Art

In the use of x-ray radiation for imaging in medical engineering, there are various application cases in which modulation of the x-ray radiation or the radiation power within different time periods is desirable. For example, in x-ray computed tomography, particularly in the acquisition of 2D x-ray projections of measurement subjects that are not rotationally symmetrical, the x-ray radiation is matched to the respective body cross section that is to be exposed.

A further application case for modulation of x-ray radiation in x-ray computed tomography is in computed tomography apparatuses with two x-ray systems that are arranged on the rotating part of the gantry, offset by approximately 90° relative to one another. In order to avoid x-ray scatter radiation generated by the operation of the x-ray source of the other x-ray system from being detected with the x-ray detector of the one x-ray system, the emission of x-ray radiation by the x-ray source of the other x-ray system should be suppressed during the readout of measurement data of the x-ray detector of the one x-ray system. The modulation of the x-ray radiation here is achieved by a temporary deactivation of the x-ray radiation or a temporary suppression of x-ray radiation.

The modulation of the x-ray radiation for the most part ensues by a corresponding operation of the x-ray tube generating the x-ray radiation, wherein the heating power of the thermal electron emitter that is used to emit electrons is preferably varied to generate and block the electron beam. The fastest response time of the x-ray tube, or of the electron emitter of the x-ray tube, is accordingly limited by the thermal inertia of the electron emitter. A problem with the technique of varying the heating power, due to the thermal inertia, for example with regard to the aforementioned example pertaining to a computed tomography apparatus with two x-ray systems is to suppress the emission of x-ray radiation by the x-ray source of the other x-ray system during the short readout of measurement data of the x-ray detector of the one x-ray system, and to immediately apply x-ray radiation with the x-ray source of the other x-ray system again after the readout.

A device to generate x-ray radiation that has a cathode electrode, a grid electrode, a focus electrode, an anode and a voltage splitter formed by ohmic resistors is described in US 2004/0114722 A1. The voltage splitter divides a tube voltage applied to the anode in order to generate a focus voltage to be applied to the focus electrode.

A device for fast dose modulation of x-ray radiation is known from WO 2008/155715 A2, in which an electron beam for generation of x-ray radiation which should be used to expose a subject strikes a first region of an anode and in which the electron beam is deflected by a deflection means toward a second region of the anode if no subject should be exposed.

In U.S. Pat. No. 4,104,526 a device is described that has a cathode to generate an electron beam, an anode to generate x-ray radiation and a control screen to modulate or to suppress the electron beam. Moreover, the device has means to detect the anode current as a measurement unit for the current generation of x-ray radiation. This anode current is used to control the potential difference between the cathode and the control screen.

SUMMARY OF THE INVENTION

An object of the present invention is to provide a device and a method of the aforementioned type such that the generation and suppression of the generation of x-ray radiation can ensue as quickly as possible. Moreover, a suitable x-ray source should be specified.

According to the invention, this object is achieved by a device to control an electron beam for the generation of x-ray radiation, that has an electron emitter that generates an electron beam, to which emitter an emitter voltage can be applied; a diaphragm; at least two control elements associated with the diaphragm to affect the electron beam; and a switching arrangement with which at least two different electrical voltages can be applied to the at least two control elements. The same electrical voltage is applied to each control element at a given point in time and, upon switching the voltage, an electrical circuit that delays the adjustment of the respective voltage at the one control element is associated with the connection line of this one control element by the switching arrangement in order to switch over the voltage.

The device functions such that the magnitude of the emitter voltage is greater than the magnitude of the first voltage applied to the two control element, such that the electron beam in a stationary state strikes an x-ray target or, respectively, an anode to generate x-ray radiation. To affect the electron beam, and thus to modulate the x-ray radiation, in the switching process a second voltage is applied to the control element to affect the electron beam. This second voltage has a magnitude that is greater than that of the emitter voltage. After the immediate switch over to the second voltage, this appears with a delay (due to the electrical voltage) at the one control element while it is essentially immediately applied at the other control element. This delayed adjustment leads to the situation that the electron beam is initially deflected by the control element to affect the electron beam in a first step and preferably strikes the diaphragm that the control element is associated with. This deflection of the electron beam takes place very quickly, such that the generation of x-ray radiation can be interrupted correspondingly quickly. In a second step that—like the first step—proceeds automatically due to switching to the second voltage, or the delayed adjustment of the second voltage at the one control element, the electron beam is advantageously completely blocked if the adjustment of the second voltage is also terminated at the one control element. The blocking of the electron beam is based on the potential difference or voltage difference between the emitter and the control element.

In order to be able to generate x-ray radiation again, the system switches over from the second voltage to the first voltage again, the magnitude of the first voltage being smaller than the magnitude of the emitter voltage. In this case as well the first voltage appears delayed—due to the electrical circuit—at the one control element while it is essentially applied immediately at the other control element. The electron beam is no longer blocked due to the switching over to the first voltage. However, the electron beam is initially, preferably deflected to the diaphragm by the delayed adjustment of the first voltage at the one control element. If the adjustment of the first voltage is also terminated at the one control element, the electron beam to generate x-ray radiation again strikes the x-ray target, i.e., the anode.

A fast control of the electron beam to generate and to suppress the generation of x-ray radiation is thus possible with the device, wherein in particular a fast deactivation of the generation of the x-ray radiation can ensue by the deflection of the electron beam, preferably onto the diaphragm. The subsequent blocking of the electron beam, moreover, does not necessarily have to ensue as quickly as possible. Rather, here it is important to keep the defocusing of the electron beam—and therefore the generation of unwanted x-ray radiation due to the uncontrolled impact of electrons on the anode—as minimal as possible. Furthermore, through the (advantageously complete) blocking of the electron beam it is prevented that the diaphragm must meet high thermal requirements, which would be the case if the electron beam were to be deflected only onto the diaphragm for suppression of the generation of x-ray radiation. In the device according to the invention, by contrast, the electron beam strikes the diaphragm only when the second voltage is present at the one control element so that the electron beam is blocked. In a modulation of the x-ray radiation by pulse width modulation, the energy application in the diaphragm is always constant per cycle by the electron beam, and in particular is also independent of the pulse width.

The emitter of electrons can be a field emitter, of a type known as a cold cathode, or a heated emitter, and an emitter voltage is applied to the emitter to generate an electron beam. The emitter voltage drops between the emitter and the anode or an additional electrode if the emitter and the emitter electrode form an electron gun to generate an electron beam.

According to one variant of the invention, the diaphragm has an aperture to pass the electron beam. Such an aperture diaphragm in particular enables fast blocking of the electron beam. While the electron beam passes unhindered through the opening of the diaphragm and strikes an x-ray target (anode) to generate x-ray radiation, this can be deflected quickly onto the diaphragm (and thus be blocked) by switching of the voltage at the control element, such that the generation of x-ray radiation is also suppressed.

According to one embodiment of the invention, the electrical circuit that delays the adjustment of the respective voltage at the one control element has an ohmic resistor and a capacitor. The ohmic resistor is advantageously connected between the switching arrangement and the control elements in the connection line. According to one variant of the invention, the capacitor is connected between the connection line of the one control element with the switching means and a feed line with which the emitter voltage can be applied to the emitter. The magnitude of the resistor and the value of the capacitor are to be selected depending on, among other things, the desired time delay of the adjustment of the voltage at the one control element.

In variants of the invention provide that the at last two control elements associated with the diaphragm are electrodes, and each control element is electrically connected with its associated diaphragm, so that the voltage applied to that control element is also applied to the diaphragm.

According to a further variant of the invention, the magnitude of the first voltage is smaller and the magnitude of the second voltage is larger than the magnitude of the emitter voltage, so blocking and unblocking of the electron beam are possible.

The object of the invention as it pertains to the x-ray tube is achieved by an x-ray tube having a device described above. The emitter, the diaphragm and the control element of the device are advantageously arranged together with an anode in a vacuum housing of the x-ray tube.

The object of the invention as it pertains to the method is achieved by a method to control an electron beam for the generation of x-ray radiation, in which an electron beam generated as a result of an emitter voltage applied to an emitter of electrons is selectively conducted through an aperture of a diaphragm to an anode, or is directed past a diaphragm to an anode, or is deflected and blocked at the diaphragm to modulate the x-ray radiation. In a switching process in which the same voltage is applied to at least two control elements associated with the diaphragm to affect the electron beam, the adjustment of the voltage at one of the control elements is delayed. The method is preferably executed with the device described above.

DESCRIPTION OF THE PREFERRED EMBODIMENTS

Figure 1:
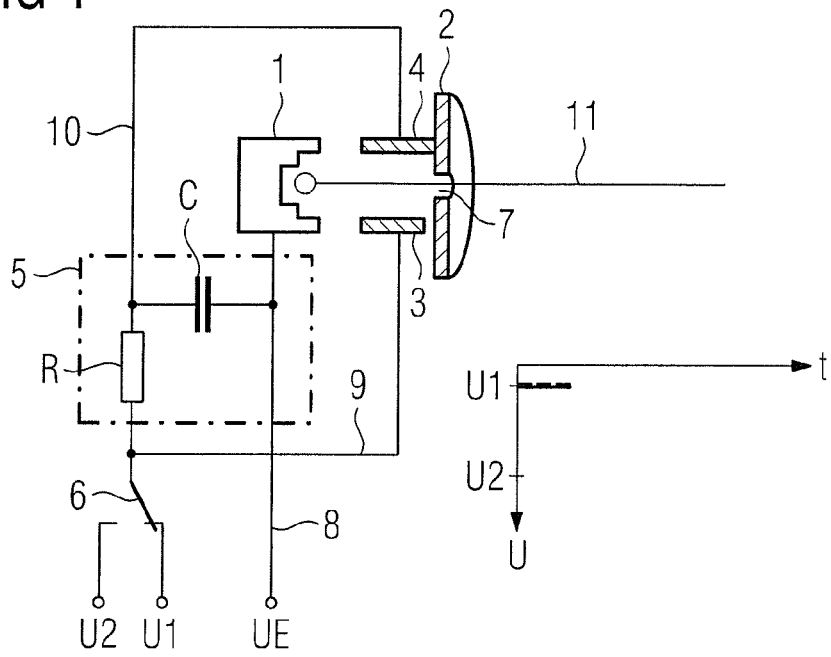
FIGS. 1-7 show a device to control an electron beam respectively in various operating states during a switching cycle.

A device according to the invention to generate and control an electron beam for the generation of x-ray radiation is shown in FIG. 1. The device has an electron emitter 1, a diaphragm 2 arranged between the electron emitter 1 and an anode (not shown in FIG. 1), two electrodes 3 and 4, an electrical circuit 5 and a switching arrangement in the form of a switch 6.

In the exemplary embodiment of the invention, the diaphragm 2 is a disc-shaped aperture diaphragm 2 with an aperture 7. In the case of the present exemplary embodiment of the invention, the aperture diaphragm 2 is electrically connected with the electrode 4.

In the exemplary embodiment of the invention, the electron emitter 1 (which, in the case of the present exemplary embodiment of the invention, is a field emitter, thus an emitter that emits electrons as a result of an electrical field) is connected with a feed line 8 to a voltage of UE=−120 kV that decreases between the electron emitter 1 and the anode. The emitter can alternatively also be a heated emitter.

The first electrode 3 is connected directly with the switch 6 with a connection line 9. The second electrode 4 is likewise connected with the switch 6 with a connection line 10. The connection line 10 is associated with the electrical circuit 5, wherein an ohmic resistor R of the electrical circuit 5 is connected in the connection line 10 and a capacitor C is connected between the connection line 10 and the feed line 8.

In the case of the present exemplary embodiment of the invention, the system can switch between the voltage U1=−119 kV and the voltage U2=−121 kV with the switch 6. If it is switched to the voltage U1, this is present both at the electrode 3 and at the electrode 4. If it is switched to the voltage U2, this is likewise present both at the electrode 3 and at the electrode 4.

In FIG. 1 the electrodes 3 and 4 are both at the voltage U1. As a result of the emitter voltage UE (whose magnitude is greater than the magnitude of the voltage U1), the electron emitter 1 emits electrons that move in an electron beam 11 (passing through the aperture 7 of the aperture diaphragm 2) in the direction of the anode (not shown) to generate x-ray radiation. In FIG. 1 a voltage-time diagram is additionally shown from which it is apparent that the voltage at the electrode 3 (illustrated by the solid line) and the voltage at the electrode 4 (illustrated by the dashed line) are the same and in the stationary state.

Figure 2:
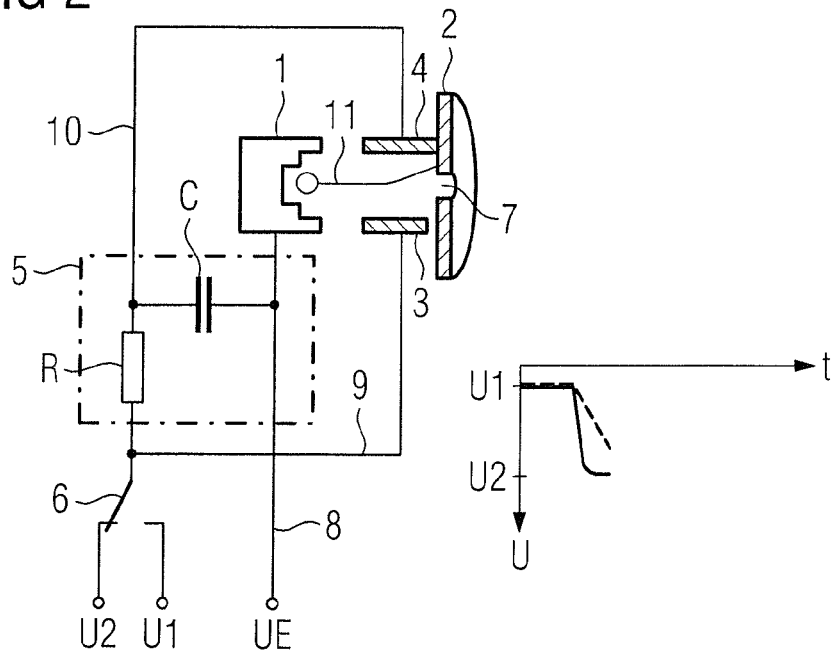

In a first Step (illustrated in FIG. 2), with the switch 6 the system switches from the voltage U1 to the voltage U2, which is smaller than or, respectively, (in terms of its magnitude) greater than the emitter voltage UE. While the voltage U2 is practically immediately applied to the electrode 3 after the switching process, its adjustment at the electrode 4 is delayed by the electrical circuit 5, which is shown in the voltage-time diagram of FIG. 2. For a short time this initially leads to a deflection of the electron beam 11 on the aperture diaphragm 2, whereby the electron beam 11 is already blocked in the desired manner for the generation of x-ray radiation. The fast deflection of the electron beam 11 thereby prevents, due to a gradual expansion of the electron beam that occurs otherwise, electrons from striking the anode in an unwanted manner and that x-ray radiation (and, in fact, what is known as extrafocal radiation) would be generated.

Figure 3:
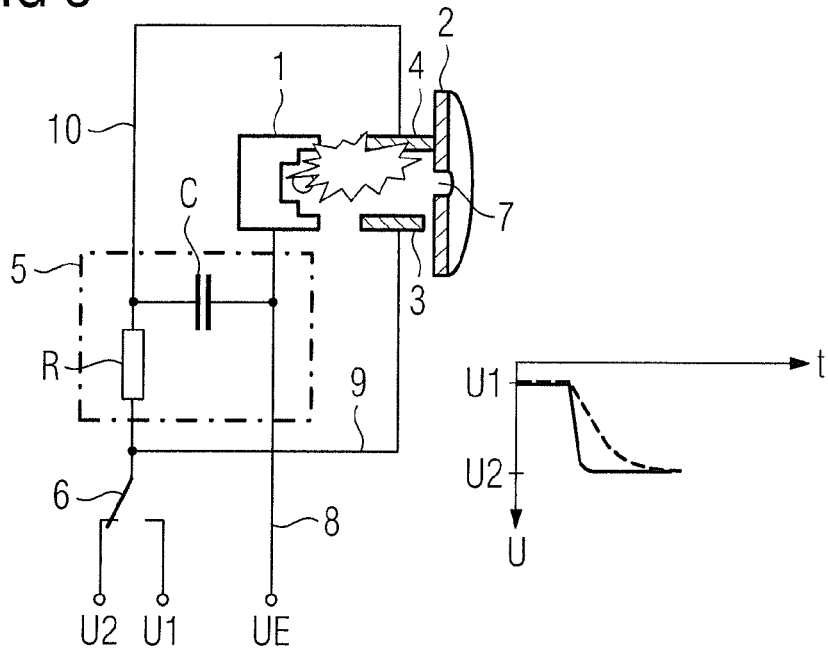
Figure 4:
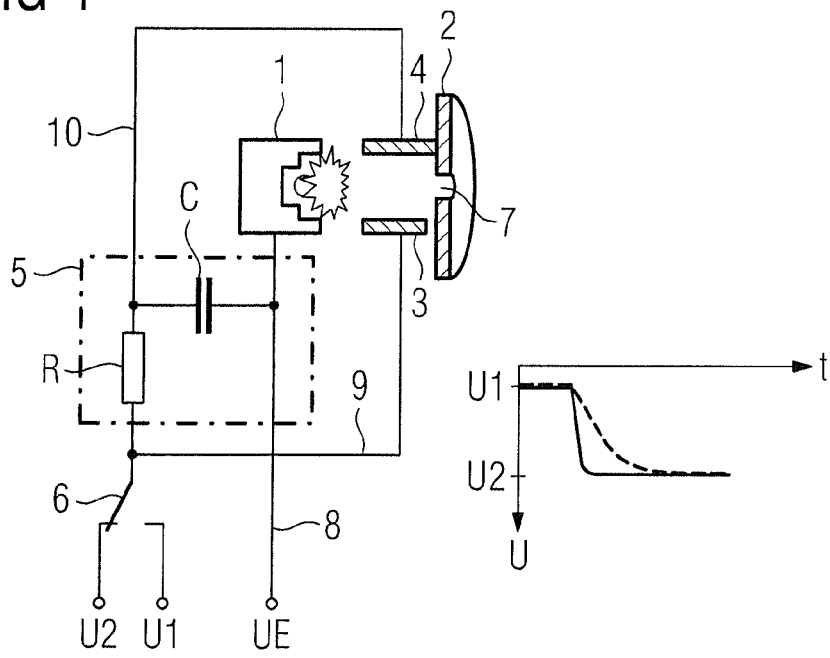

If the voltage U2 is delayed due to the resistance circuit but is finally set in full at the electrode 4 and the aperture diaphragm 2 (which can be learned from the voltage-time diagrams of FIG. 3 and FIG. 4 in chronological order), the electron beam 11 is completely blocked as a result of the now stationary potential difference between the electron emitter 1 and the electrodes 3 and 4 as well as the aperture diaphragm 2, which means that no electron beam strikes or, respectively, no electrons strike the aperture diaphragm 2. The aperture diaphragm 2 thus must accept a certain power only in the brief time between deflection of the electron beam 11 and its blocking, such that no high thermal requirements must be placed on the aperture diaphragm 2.

Figure 5:
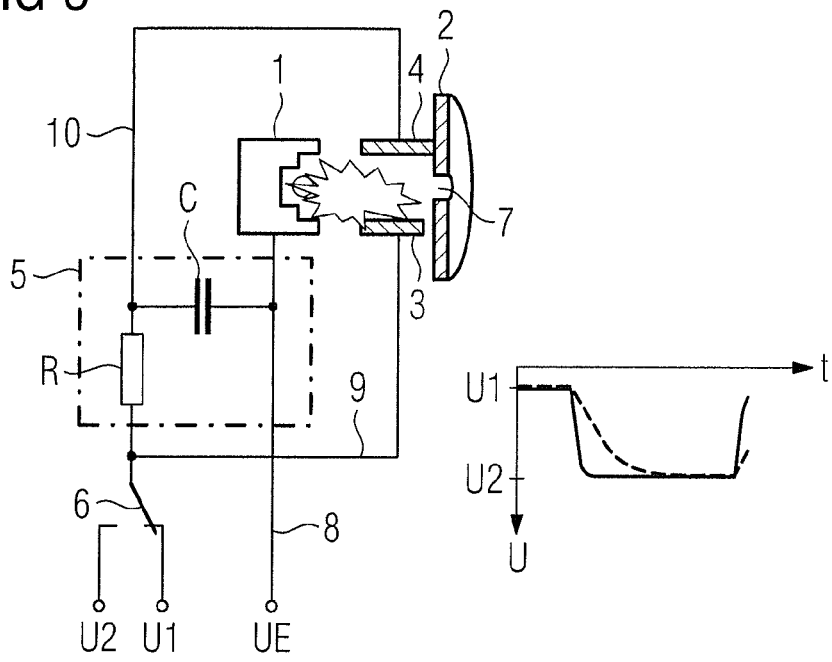
Figure 6:
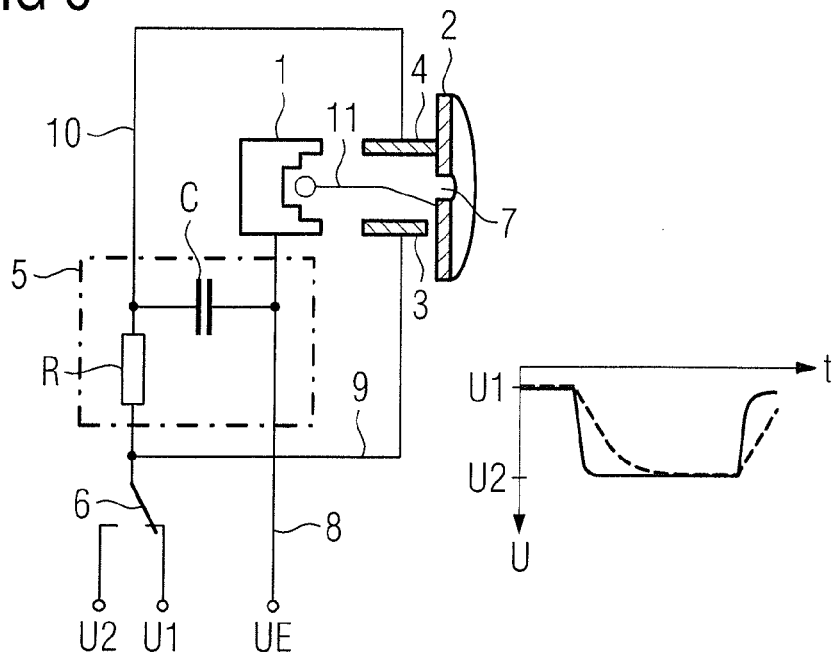

If x-ray radiation should be generated again, the system switches again to the voltage U1 with the switch 6. While the voltage U1 is practically immediately applied to the electrode 3 with the switch-over, the setting of the voltage U1 at the electrode 4 is delayed again as a result of the electrical circuit 5. As illustrated in FIG. 5, the electron beam 11 begins to form again with the switch to voltage U1 (which is smaller in terms of magnitude), wherein the electron beam 11 initially strikes the aperture diaphragm 2 (as shown in FIG. 6) as long as the voltage U1 is not yet completely applied to the electrode 4.

Figure 7:
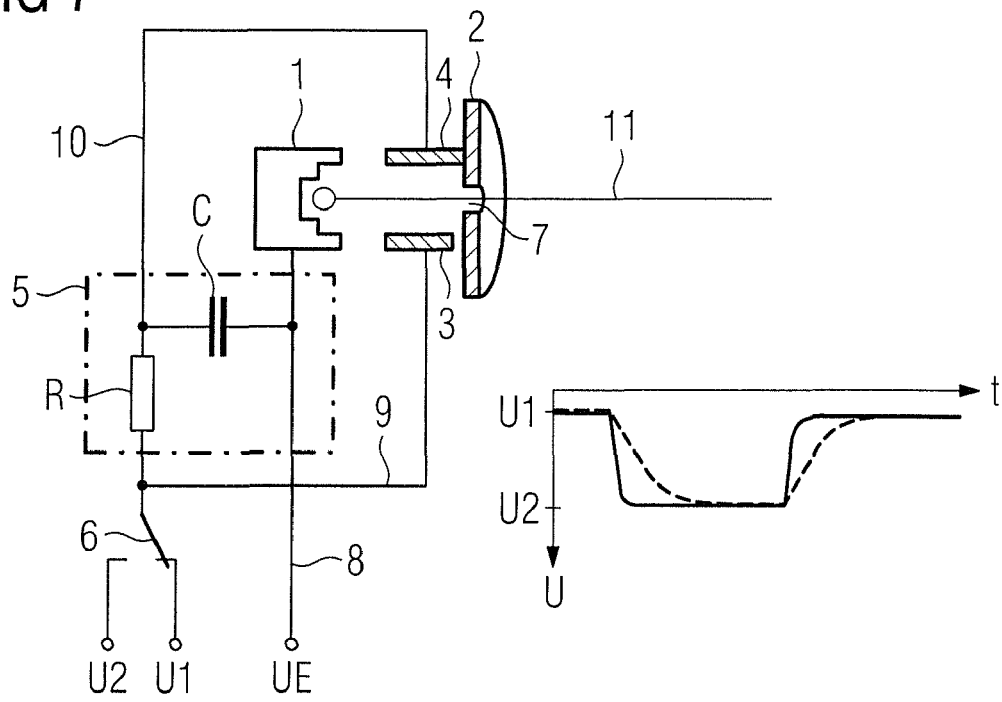

If the voltage U1 is also completely applied to the electrode 4, the operating state shown in FIG. 7 (which corresponds to the operating state shown in FIG. 1) results, namely that the electron beam 11 passes through the aperture 7 of the aperture diaphragm and strikes an anode (not shown) to generate x-ray radiation.

In the voltage-time diagrams, FIGS. 1 through 7 illustrate a switching cycle for the modulation of the electron beam 11, wherein the solid line shows the adjustment or the voltage curve over time of the voltage applied to the electrode 3 and the dashed line shows the adjustment or, respectively, the voltage curve over time of the voltage applied to the electrode 4. For example, such a switching cycle can have a cycle length of approximately 200 μs, wherein the time between the deflection of the electron beam and the blocking of the electron beam is approximately 5 μs. Assuming that there would be a potential difference of 10 kV between electron emitter 1 and aperture diaphragm 2, and an electron current of approximately 1 ampere would flow, an average power yield of approximately 250 watts would result for the aperture diaphragm 2 in the 5 μ-seconds from the deflection of the electron beam 11 until the blocking of the electron beam 11.

Figure 8:
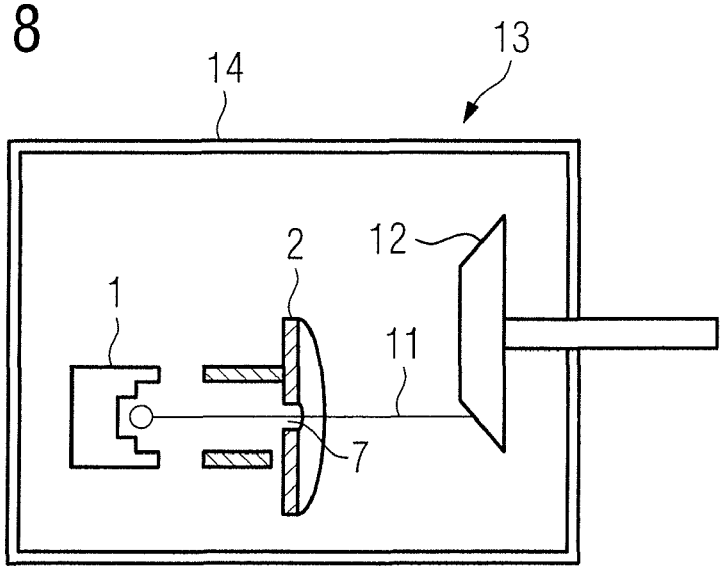
FIG. 8 shows an x-ray tube having a device shown in FIGS. 1-7.

In FIG. 8 the device of FIGS. 1 through 7 is shown as part of an x-ray tube 13 possessing an anode 12. The device and the anode 12 are arranged in a vacuum housing 14 of the x-ray tube 13. The wiring of the x-ray tube 13, in particular the wiring of the device, is not explicitly shown again in FIG. 8.

The preceding description of the invention is moreover to be understood merely as an example. The field emitter 1 is thus only schematically shown and can also be executed differently. The electrodes 3 and 4 can be executed as flat or curved electrode plates, in particular electrode plates curved in the shape of a semicircle.

The diaphragm 2 does not necessarily have to be an aperture diaphragm. The diaphragm can also be executed such that the electron beam is directed past the diaphragm to generate x-ray radiation and is deflected onto the diaphragm to block the electron beam.

Although modifications and changes may be suggested by those skilled in the art, it is the intention of the inventors to embody within the patent warranted hereon all changes and modifications as reasonably and properly come within the scope of their contribution to the art.

We claim as our invention:

1. A device to control an electron beam for generating x-ray radiation, said device comprising:

an electron emitter that emits electrons to generate an electron beam, said emitter having an emitter voltage applied thereto;

a diaphragm located in a path of said electrons emitted by said emitter that interacts with said electrons to modulate said electron beam;

at least two control elements located at said diaphragm that interact with said diaphragm to alter an effect of said diaphragm on said electron beam; and a switching arrangement electrically connected to each of said at least two control elements, said switching arrangement being switchable between a first switching state that causes said diaphragm to have a first effect on said electron beam, in which said switching arrangement supplies a first voltage to each of said at least two control elements, and a second switching state that causes said diaphragm to have a different, second effect on said electron beam, in which said switching arrangement supplies a second voltage to each of said at least two control elements; and an electrical circuit connected between said switching arrangement and one of said at least two control elements, said electrical circuit delaying respectively application of said first and second voltages to said one of said at least two control elements upon switching of said switching arrangement between said first and second switching states.

2. A device as claimed in claim 1 wherein said diaphragm comprises an aperture through which said electron beam passes, and wherein said at least two control elements are located at opposite sides of said aperture.

3. A device as claimed in claim 1 wherein said electrical circuit comprises an ohmic resistor and a capacitor.

4. A device as claimed in claim 3 wherein said ohmic resistor is connected between said switching arrangement and said one of said at least two control elements via an electrical connection line.

5. A device as claimed in claim 4 comprising a feedline that feeds said emitter voltage to said emitter, and wherein said capacitor is connected between said connection line and said feedline.

6. A device as claimed in claim 1 wherein said at least two control elements are at least two control electrodes.

7. A device as claimed in claim 1 wherein said one of said control elements is in electrical connection with said diaphragm.

8. A device as claimed in claim 1 wherein said first voltage has a magnitude that is smaller than a magnitude of said emitter voltage, and wherein said second voltage has a magnitude that is larger than the magnitude of said emitter voltage.

9. An x-ray tube comprising:

an evacuated housing;

an anode comprising an anode surface, at least said anode surface being located in said evacuated housing;

an electron emitter that emits electrons to generate an electron beam that strikes said anode surface to cause x-ray radiation to be emitted from said anode surface, said emitter having an emitter voltage applied thereto;

a diaphragm located in a path of said electrons emitted by said emitter that interacts with said electrons to modulate said electron beam;

at least two control elements located at said diaphragm that interact with said diaphragm to alter an effect of said diaphragm on said electron beam; and a switching arrangement electrically connected to each of said at least two control elements, said switching arrangement being switchable between a first switching state that causes said diaphragm to have a first effect on said electron beam, in which said switching arrangement supplies a first voltage to each of said at least two control elements, and a second switching state that causes said diaphragm to have a different, second effect on said electron beam, in which said switching arrangement supplies a second voltage to each of said at least two control elements; and an electrical circuit connected between said switching arrangement and one of said at least two control elements, said electrical circuit delaying respectively application of said first and second voltages to said one of said at least two control elements upon switching of said switching arrangement between said first and second switching states.

10. A method to control an electron beam to generate x-ray radiation, comprising the steps of:

applying an emitter voltage to an electron emitter to cause electrons to be emitted from said electron emitter in an electron beam, said electrons striking an anode surface to cause x-ray radiation to be emitted therefrom;

modulating said electron beam and the emission of x-ray radiation with a diaphragm that interacts with said electrons in said electron beam, said diaphragm having at least two control elements associated therewith;

applying respective voltages to each of said at least two control elements and selectively switching said respective voltages applied to said at least two control elements to selectively block or permit passage of said electron beam beyond said diaphragm to modulate said x-ray radiation; and after switching said respective voltages applied to each of said at least two control elements, delaying application of one of the respective voltages applied to each of said at least two control elements to one of said at least two control elements.

11. A method as claimed in claim 10 wherein application of said one of the respective voltages applied to said one of said at least two control elements is delayed by connecting an electrical circuit between a switch, that switches said respective voltages applied to each of said at least two control elements, and said one of said at least two control elements, said electrical circuit introducing a delay between said switch and said one of said at least two control elements.

12. A method as claimed in claim 11 comprising providing an ohmic resistor and a capacitor in said electrical circuit to delay said one of the respective voltages to said one of said at least two control elements.

13. A method as claimed in claim 12 wherein said electrical circuit is connected in a connection line between said switch and said one of said least two control elements, and comprising connecting said ohmic resistor in said connection line.

14. A method as claimed in claim 12 comprising applying said emitter voltage to said emitter via a feedline, and connecting said capacitor between said connection line and said feedline.

15. A method as claimed in claim 10 comprising switching said at least two control elements between a first voltage, among the respective voltages applied to each of said at least two control elements having a magnitude that is smaller than a magnitude of said emitter voltage, and a second voltage, among the respective voltages applied to each of said at least two control elements having a magnitude that is larger than said magnitude of the emitter voltage.

16. A method as claimed in claim 15 comprising, upon switching from said first voltage to said second voltage with said second voltage being delayed at said one of said control elements, initially deflecting said electron beam at said diaphragm and thereafter blocking said electron beam when said second voltage is completely present at said one of said control elements.

17. A method as claimed in claim 15 wherein said electron beam initially strikes said diaphragm upon switching from said first voltage to said second voltage with said second voltage being delayed at said one of said control elements, and wherein said electron beam passes beyond said diaphragm when the first voltage is completely present at said one of said control elements.

* * * * *